US009019179B2

(12) United States Patent
Sun et al.

(10) Patent No.: US 9,019,179 B2
(45) Date of Patent: Apr. 28, 2015

(54) PIXEL CIRCUIT OF ORGANIC LIGHT EMITTING DIODE

(71) Applicant: Chunghwa Picture Tubes, Ltd., Taoyuan (TW)

(72) Inventors: Bo-Jhang Sun, Kaohsiung (TW); Chin-Hai Huang, Taoyuan County (TW); Szu-Chi Huang, Changhua County (TW)

(73) Assignee: Chunghwa Picture Tubes, Ltd., Taoyuan (TW)

( * ) Notice: Subject to any disclaimer, the term of this patent is extended or adjusted under 35 U.S.C. 154(b) by 81 days.

(21) Appl. No.: 14/052,770

(22) Filed: Oct. 13, 2013

(65) Prior Publication Data

US 2015/0049006 A1 Feb. 19, 2015

(30) Foreign Application Priority Data

Aug. 19, 2013 (TW) ..... 102129666 A

(51) Int. Cl.
*G09G 3/30* (2006.01)
*G09G 3/32* (2006.01)

(52) U.S. Cl.
CPC ..... *G09G 3/3266* (2013.01)

(58) Field of Classification Search
CPC ..... G09G 2300/0842; G09G 3/3233; G09G 2320/043
USPC ..... 345/76–83, 92; 315/169.1–169.4
See application file for complete search history.

(56) References Cited

U.S. PATENT DOCUMENTS

| | | | | |
|---|---|---|---|---|
| 8,384,632 | B2 * | 2/2013 | Chiou | 345/82 |
| 8,384,701 | B2 | 2/2013 | Kang et al. | |
| 2008/0238890 | A1 * | 10/2008 | Chiou | 345/204 |
| 2011/0187695 | A1 * | 8/2011 | Komura | 345/211 |
| 2012/0139894 | A1 | 6/2012 | Nathan et al. | |
| 2013/0069928 | A1 * | 3/2013 | Mizusako et al. | 345/212 |
| 2013/0300724 | A1 * | 11/2013 | Chaji | 345/212 |
| 2014/0049531 | A1 * | 2/2014 | Kwak | 345/211 |
| 2014/0055434 | A1 * | 2/2014 | Chang et al. | 345/208 |
| 2014/0092076 | A1 * | 4/2014 | Lee | 345/212 |
| 2014/0168184 | A1 * | 6/2014 | Kim et al. | 345/209 |

FOREIGN PATENT DOCUMENTS

TW 201201178 1/2012

* cited by examiner

*Primary Examiner* — Kimnhung Nguyen
(74) *Attorney, Agent, or Firm* — Jianq Chyun IP Office

(57) ABSTRACT

A pixel circuit of an organic light emitting diode (OLED) is provided. The pixel circuit includes an OLED, a first transistor, a second transistor and a capacitor. The OLED receives a first voltage. A terminal of the first transistor is coupled to the OLED, and another terminal of the first transistor receives a second voltage. A terminal of the second transistor is coupled to the terminal of the first transistor, another terminal of the second transistor is coupled to a control terminal of the first transistor, a control terminal of the second transistor receives a scan signal. The capacitor is coupled between the control terminal of the first transistor and a third voltage. When the scan signal is enabled, the second voltage is set to a data voltage, the third voltage is set to a reference voltage, and the first voltage is set to a low voltage.

11 Claims, 4 Drawing Sheets

PIXEL CIRCUIT OF ORGANIC LIGHT EMITTING DIODE

CROSS-REFERENCE TO RELATED APPLICATION

This application claims the priority benefit of Taiwan application serial no. 102129666, filed on Aug. 19, 2013. The entirety of the above-mentioned patent application is hereby incorporated by reference herein and made a part of this specification.

BACKGROUND

1. Technical Field

The invention relates to a pixel circuit. Particularly, the invention relates to a pixel circuit of an organic light emitting diode (OLED).

2. Related Art

Along with progress of technology, flat panel display has become a most noticeable display technique in recent years. Since an organic light emitting diode display has advantages of self-luminous, wide viewing-angle, low power consumption, simple fabrication process, low cost, low operation temperature range, high response speed and full color, etc., the OLED display has a great application potential, which is expected to become a mainstream of the flat panel display of a next generation.

In order to control a luminance of the OLED, the OLED is generally connected with a transistor in series. A current flowing through the OLED can be controlled by controlling a conducting level of the transistor, so as to control the luminance of the OLED. Generally, due to the influence of electrical characteristics of the transistor, a display effect of each pixel is probably different. Therefore, to uniform the display effects of the pixels through a circuit design becomes an important issue in driving of the OLED.

SUMMARY

Accordingly, the invention is directed to a pixel circuit of an OLED, which improves image display quality.

The invention provides a pixel circuit of an OLED including an OLED, a first transistor, a second transistor and a first capacitor. The OLED receives a first voltage. The first transistor has a first terminal, a second terminal and a first control terminal, where the first terminal is coupled to the OLED, and the second terminal receives a second voltage. The second transistor has a third terminal, a fourth terminal and a second control terminal, where the third terminal is coupled to the first terminal, the fourth terminal is coupled to the first control terminal, and the second control terminal receives a scan signal. The first capacitor is coupled between the first control terminal and a third voltage. When the scan signal is enabled, the second voltage is set to a data voltage, the third voltage is set to a reference voltage, and the first voltage is set to a low voltage, where the reference voltage and the data voltage are smaller than or equal to a high voltage, and the reference voltage and the data voltage are greater than or equal to the low voltage.

According to the above descriptions, in the pixel circuit of the OLED, the luminance of the OLED is controlled by the data voltage and the reference voltage, so that the influence of a threshold voltage of the first transistor is eliminated, i.e. it is regarded that the threshold voltage is compensated.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION OF DISCLOSED EMBODIMENTS

Figure 1A:
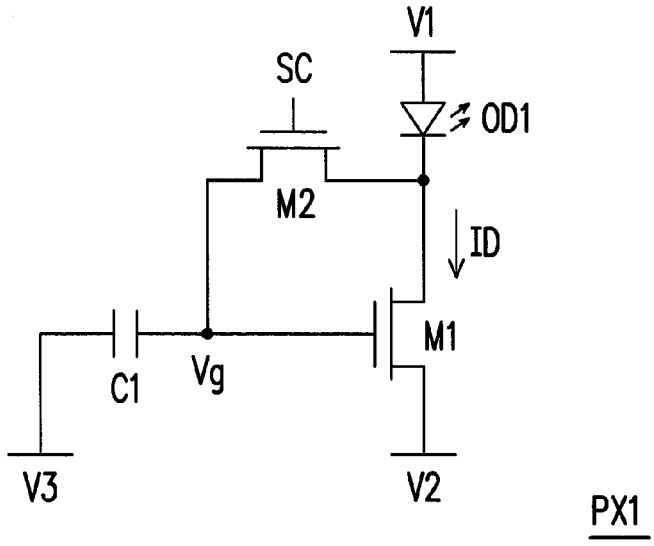
FIG. 1A is a circuit schematic diagram of a pixel circuit of an organic light emitting diode (OLED) according to a first embodiment of the invention.

FIG. 1A is a circuit schematic diagram of a pixel circuit of an OLED according to a first embodiment of the invention. Referring to FIG. 1A, in the present embodiment, the pixel circuit PX1 includes an OLED OD1, a first transistor M1, a second transistor M2 and a first capacitor C1, where the first transistor M1 and the second transistor M2 are respectively an N-type transistor. A cathode of the OLED OD1 receives a first voltage V1, and an anode of the OLED OD1 is coupled to a drain (corresponding to a first terminal) of the first transistor M1. A source (corresponding to a second terminal) of the first transistor M1 receives a second voltage V2. A drain (corresponding to a third terminal) of the second transistor M2 is coupled to the drain of the first transistor M1, a source (corresponding to a fourth terminal) of the second transistor M2 is coupled to a gate (corresponding to a first control terminal) of the first transistor M1, and a gate (corresponding to a second control terminal) of the second transistor M2 receives a scan signal SC. The first capacitor C1 is coupled between the gate of the first transistor M1 and a third voltage V3.

Figure 1B:
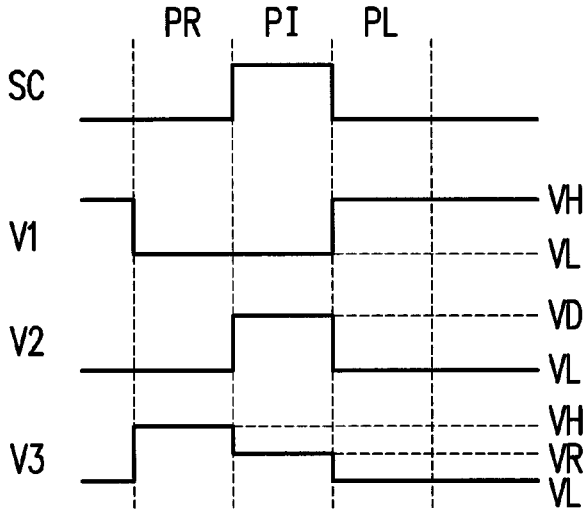
FIG. 1B is a schematic diagram of a driving waveform of a pixel circuit according to the first embodiment of the invention.

FIG. 1B is a schematic diagram of a driving waveform of the pixel circuit according to the first embodiment of the invention. Referring to FIG. 1A and FIG. 1B, in the present embodiment, an operation timing of the pixel circuit PX1 is at least divided into three phases, for example, a reset phase PR, a data writing phase PI and a light emitting phase PL. The data writing phase PI is neighboring to the reset phase PR and the light emitting phase PL, and the reset phase PR is prior to the light emitting phase PL.

In the reset phase PR, the scan signal SC is disabled (for example, a low voltage level), the first voltage V1 and the second voltage V2 are set to a low voltage VL, and the third voltage V3 is set to a high voltage VH. Now, the first transistor M1 is turned-on, the second transistor M2 is turned-off, and the OLED OD1 is reversely biased and is turned-off. In this way, a gate voltage Vg of the first transistor M1 is reset.

In the data writing phase PI, the scan signal SC is enabled (for example, a high voltage level), the first voltage V1 is set to the low voltage VL, the second voltage V2 is set to a data voltage VD, and the third voltage V3 is set to a reference voltage VR. The reference voltage VR and the data voltage VD are generally smaller than or equal to the high voltage VH, and the reference voltage VR and the data voltage VD are generally greater than or equal to the low voltage VL. Now, the first transistor M1 and the second transistor M2 are turned-on, and the OLED OD1 is still reversely biased and is turned-off. In this way, the gate voltage Vg of the first transistor Ml is charged to VD+Vth, where VD is the data voltage VD, and Vth is a threshold voltage of the transistor M1.

In the light emitting phase PL, the scan signal SC is disabled, the first voltage V1 is set to the high voltage VH, and the second voltage V2 and the third voltage V3 are set to the low voltage VL. Now, the first transistor M1 is turned-on, the second transistor M2 is turned-off, and the OLED OD1 is forward biased and is turned-on. Moreover, the gate voltage Vg of the first transistor M1 is VD+Vth−VR+VL, where VR is the reference voltage VR, VL is the low voltage VL, and a current ID flowing through the first transistor M1 (i.e. the current flowing through the OLED OD1) is $k(VD+Vth-VR+VL-VL-Vth)^2$, where k is a current coefficient of the first transistor M1. After simplification, the current ID is $k(VD-VR)^2$. The reference voltage VR can be adjusted according to a circuit requirement, for example, for voltage compensation, through in some embodiments, the reference voltage VR can be set to a ground voltage, and the current ID is $k(VD)^2$, i.e. a luminance of the OLED OD1 is completely controlled by the data voltage VD.

According to the above descriptions, the luminance of the OLED OD1 of the pixel circuit PX1 is controlled by the data voltage VD and the reference voltage VR, so that the influence of the threshold voltage Vth of the first transistor M1 is eliminated, i.e. it can be regarded that the threshold voltage Vth is compensated. Moreover, since the pixel circuit PX1 applies a inverted design of the OLED OD1, i.e. the drain of the first transistor M1 is coupled to the OLED OD1, a cross voltage of the OLED OD1 has a low influence on the current ID, i.e. the luminance of the OLED OD1 is stable. Moreover, the first transistor M1 and the second transistor M2 are all N-type transistors, by which a hardware cost is decreased and a fabrication process of the pixel circuit PX1 is simplified.

Figure 2A:
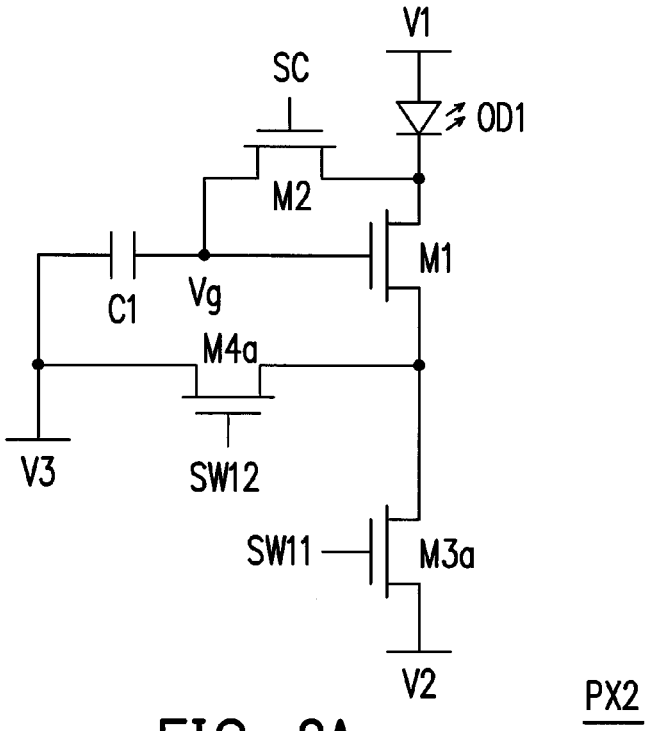
FIG. 2A is a circuit schematic diagram of a pixel circuit of an OLED according to a second embodiment of the invention.

FIG. 2A is a circuit schematic diagram of a pixel circuit of an OLED according to a second embodiment of the invention. Referring to FIG. 1A and FIG. 2A, in the present embodiment, compared to the pixel circuit PX1, the pixel circuit PX2 further includes a third transistor M3*a* and a fourth transistor M4*a*, where the same reference numbers refer to the same or like parts. In the present embodiment, the third transistor M3*a* and the fourth transistor M4*a* are, for example, all N-type transistors.

A drain (corresponding to a fifth terminal) of the third transistor M3*a* is coupled to the source of the first transistor M1, a source (corresponding to a sixth terminal) of the third transistor M3*a* receives the second voltage V2, and a gate (corresponding to a third control terminal) of the third transistor M3*a* receives a first switch signal SW11. The source of the first transistor M1 receives the second voltage V2 through the turned-on third transistor M3*a*. A drain (corresponding to a seventh terminal) of the fourth transistor M4*a* is coupled to the source of the first transistor M1, a source (corresponding to an eighth terminal) of the fourth transistor M4*a* receives the third voltage V3, and a gate (corresponding to a fourth control terminal) of the fourth transistor M4*a* receives the second switch signal SW12.

Figure 2B:
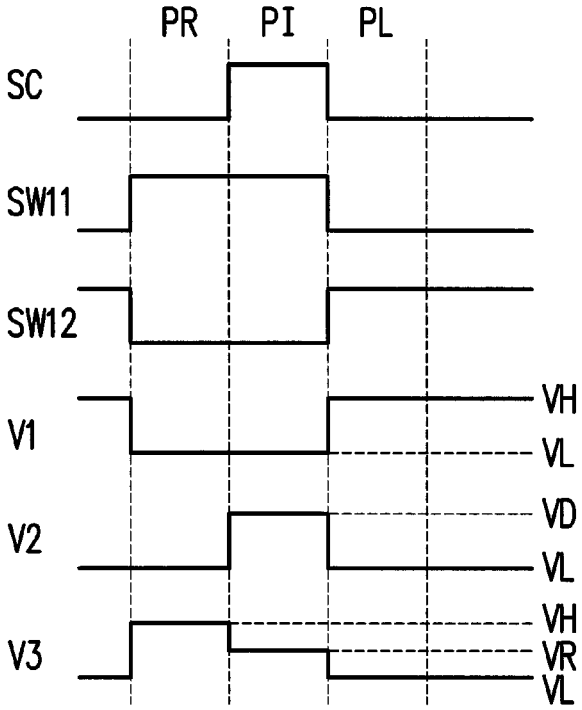
FIG. 2B is a schematic diagram of a driving waveform of a pixel circuit according to the second embodiment of the invention.

FIG. 2B is a schematic diagram of a driving waveform of the pixel circuit according to the second embodiment of the invention. Referring to FIG. 1A, FIG. 1B, FIG. 2A and FIG. 2B, where the same reference numbers refer to the same or like parts. In the present embodiment, the first switch signal SW11 is enabled during the reset phase PR and the data writing phase PI (for example, the high voltage level), and the first switch signal SW11 is disabled during the light emitting phase PL (for example, the low voltage level). The second switch signal SW12 is disabled during the reset phase PR and the data writing phase PI (for example, the low voltage level), and the second signal SW12 is enabled during the light emitting phase PL (for example, the high voltage level). In other words, the first switch signal SW11 is inverted to the second switch signal SW12, i.e. the second switch signal SW12 can be regarded as an inverted signal of the first switch signal SW11.

According to the above descriptions, the third transistor M3*a* is controlled by the first switch signal SW11 and is turned-on during the reset phase PR and the data writing phase PI, and the third transistor M3*a* is controlled by the first switch signal SW11 and is turned-off during the light emitting phase PL. The fourth transistor M4*a* is controlled by the second switch signal SW12 and is turned-off during the reset phase PR and the data writing phase PI, and the fourth transistor M4*a* is controlled by the second switch signal SW12 and is turned-on during the light emitting phase PL. The circuit operation of the pixel circuit PX2 is substantially the same to the circuit operation of the pixel circuit PX1.

Figure 3A:
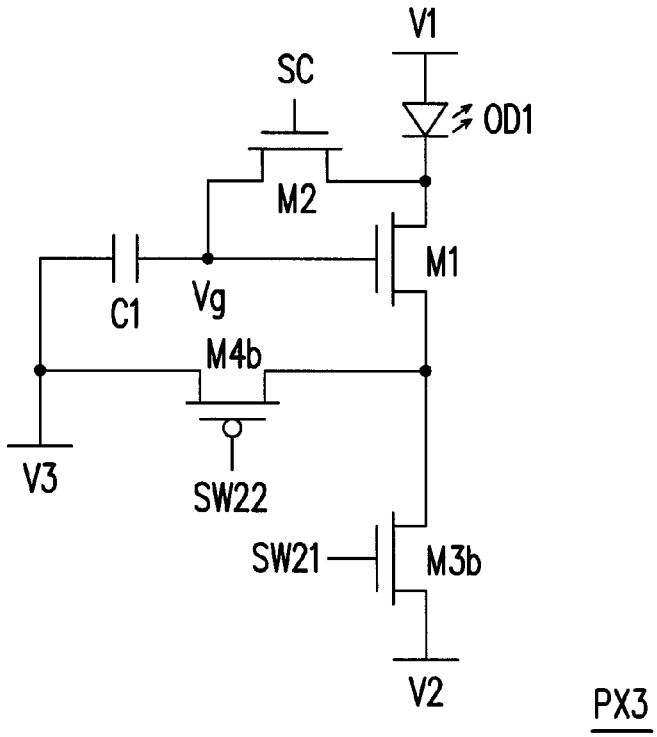
FIG. 3A is a circuit schematic diagram of a pixel circuit of an OLED according to a third embodiment of the invention.

FIG. 3A is a circuit schematic diagram of a pixel circuit of an OLED according to a third embodiment of the invention. Referring to FIG. 1A and FIG. 3A, in the present embodiment, compared to the pixel circuit PX1, the pixel circuit PX3 further includes a third transistor M3*b* and a fourth transistor M4*b*, where the same reference numbers refer to the same or like parts. In the present embodiment, the third transistor M3*b* is, for example, an N-type transistor and the fourth transistor M4*b* is, for example, a P-type transistor.

A drain (corresponding to the fifth terminal) of the third transistor M3*b* is coupled to the source of the first transistor M1, a source (corresponding to the sixth terminal) of the third transistor M3*b* receives the second voltage V2, and a gate (corresponding to the third control terminal) of the third transistor M3*b* receives a first switch signal SW21. The source of the first transistor M1 receives the second voltage V2 through the turned-on third transistor M3*b*. A drain (corresponding to the seventh terminal) of the fourth transistor M4*b* is coupled to the source of the first transistor M1, a source (corresponding to the eighth terminal) of the fourth transistor M4*b* receives the third voltage V3, and a gate (corresponding to the fourth control terminal) of the fourth transistor M4*b* receives a second switch signal SW22.

Figure 3B:
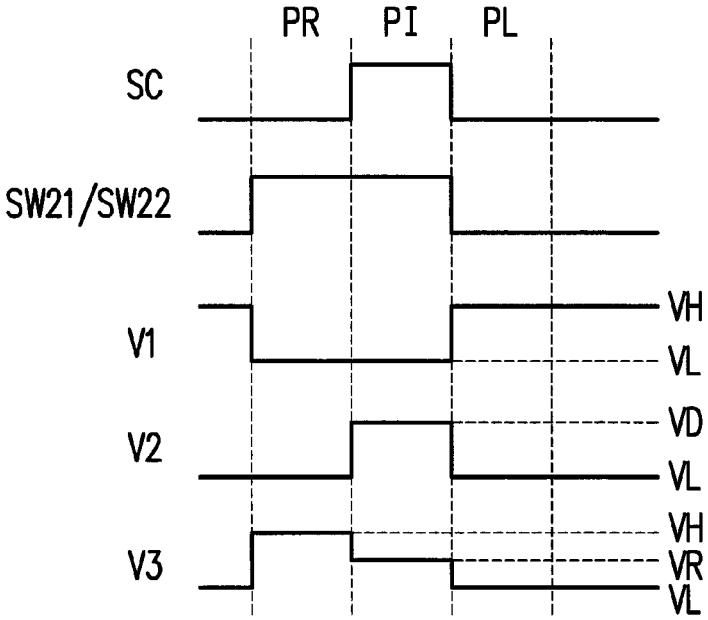
FIG. 3B is a schematic diagram of a driving waveform of a pixel circuit according to the third embodiment of the invention.

FIG. 3B is a schematic diagram of a driving waveform of the pixel circuit according to the third embodiment of the invention. Referring to FIG. 1A, FIG. 1B, FIG. 3A and FIG. 3B, where the same reference numbers refer to the same or like parts. In the present embodiment, the first switch signal SW21 is enabled during the reset phase PR and the data writing phase PI (for example, the high voltage level), and the first switch signal SW21 is disabled during the light emitting phase PL (for example, the low voltage level). The second switch signal SW22 is disabled during the reset phase PR and the data writing phase PI (for example, the high voltage level), and the second signal SW22 is enabled during the light emitting phase PL (for example, the low voltage level). In other words, the first switch signal SW21 is the same to the second switch signal SW22.

According to the above descriptions, the third transistor M3*b* is controlled by the first switch signal SW21 and is turned-on during the reset phase PR and the data writing phase PI, and the third transistor M3*b* is controlled by the first switch signal SW21 and is turned-off during the light emitting phase PL. The fourth transistor M4*b* is controlled by the second switch signal SW22 and is turned-off during the reset phase PR and the data writing phase PI, and the fourth transistor M4*b* is controlled by the second switch signal SW22 and is turned-on during the light emitting phase PL. The circuit operation of the pixel circuit PX3 is substantially the same to the circuit operation of the pixel circuit PX1.

Figure 4A:
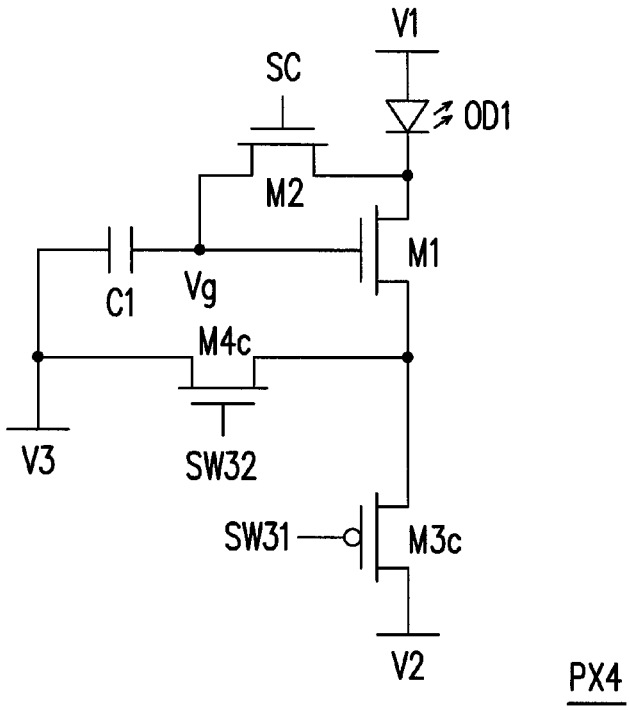
FIG. 4A is a circuit schematic diagram of a pixel circuit of an OLED according to a fourth embodiment of the invention.

FIG. 4A is a circuit schematic diagram of a pixel circuit of an OLED according to a fourth embodiment of the invention. Referring to FIG. 1A and FIG. 4A, in the present embodiment, compared to the pixel circuit PX1, the pixel circuit PX4 further includes a third transistor M3*c* and a fourth transistor M4*c*, where the same reference numbers refer to the same or like parts. In the present embodiment, the third transistor M3*c* is, for example, a P-type transistor and the fourth transistor M4*c* is, for example, an N-type transistor.

A drain (corresponding to the fifth terminal) of the third transistor M3*c* is coupled to the source of the first transistor M1, a source (corresponding to the sixth terminal) of the third transistor M3*c* receives the second voltage V2, and a gate (corresponding to the third control terminal) of the third transistor M3*c* receives a first switch signal SW31. The source of the first transistor M1 receives the second voltage V2 through the turned-on third transistor M3*c*. A drain (corresponding to the seventh terminal) of the fourth transistor M4*c* is coupled to the source of the first transistor M1, a source (corresponding to the eighth terminal) of the fourth transistor M4*c* receives the third voltage V3, and a gate (corresponding to the fourth control terminal) of the fourth transistor M4*c* receives a second switch signal SW32.

Figure 4B:
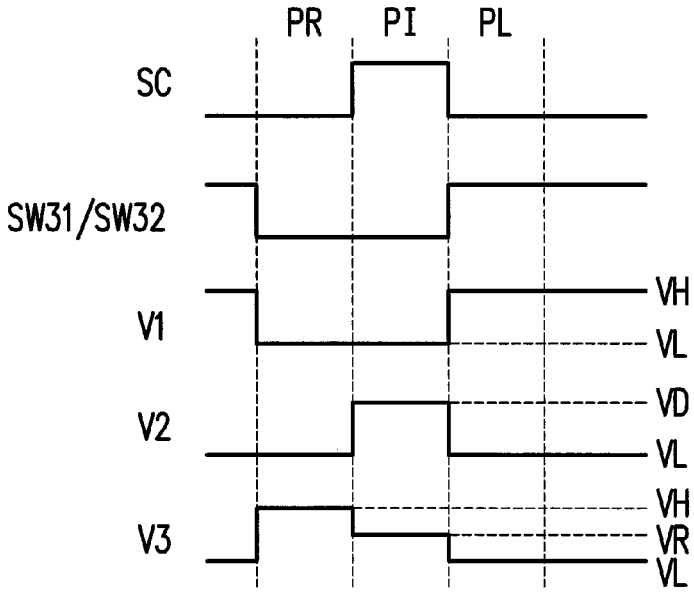
FIG. 4B is a schematic diagram of a driving waveform of a pixel circuit according to the fourth embodiment of the invention.

FIG. 4B is a schematic diagram of a driving waveform of the pixel circuit according to the fourth embodiment of the invention. Referring to FIG. 1A, FIG. 1B, FIG. 4A and FIG. 4B, where the same reference numbers refer to the same or like parts. In the present embodiment, the first switch signal SW31 is enabled during the reset phase PR and the data writing phase PI (for example, the low voltage level), and the first switch signal SW31 is disabled during the light emitting phase PL (for example, the high voltage level). The second switch signal SW32 is disabled during the reset phase PR and the data writing phase PI (for example, the low voltage level), and the second switch signal SW32 is enabled during the light emitting phase PL (for example, the high voltage level). In other words, the first switch signal SW31 is the same to the second switch signal SW32.

According to the above descriptions, the third transistor M3*c* is controlled by the first switch signal SW31 and is turned-on during the reset phase PR and the data writing phase PI, and the third transistor M3*c* is controlled by the first switch signal SW31 and is turned-off during the light emitting phase PL. The fourth transistor M4*c* is controlled by the second switch signal SW32 and is turned-off during the reset phase PR and the data writing phase PI, and the fourth transistor M4*c* is controlled by the second switch signal SW32 and is turned-on during the light emitting phase PL. The circuit operation of the pixel circuit PX4 is substantially the same to the circuit operation of the pixel circuit PX1.

In summary, in the pixel circuit of the OLED of the invention, the luminance of the OLED is controlled by the data voltage and the reference voltage, so that the influence of the threshold voltage of the first transistor is eliminated, i.e. it is regarded that the threshold voltage is compensated. Moreover, since the drain of the first transistor is coupled to the OLED, the cross voltage of the OLED has lower influence on the drain current of the first transistor, i.e. the luminance of the OLED is stable. In addition, when the transistors in the pixel circuit are all N-type transistors, the hardware cost can be decreased and the fabrication process of the pixel circuit can be simplified.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. A pixel circuit of an organic light emitting diode (OLED), comprising:

an OLED, receiving a first voltage;

a first transistor, having a first terminal, a second terminal and a first control terminal, wherein the first terminal is coupled to the OLED, and the second terminal receives a second voltage;

a second transistor, having a third terminal, a fourth terminal and a second control terminal, wherein the third terminal is coupled to the first terminal, the fourth terminal is coupled to the first control terminal, and the second control terminal receives a scan signal; and a first capacitor, coupled between the first control terminal and a third voltage, wherein when the scan signal is enabled, the second voltage is set to a data voltage, the third voltage is set to a reference voltage, and the first voltage is set to a low voltage, wherein the reference voltage and the data voltage are smaller than or equal to a high voltage, and the reference voltage and the data voltage are greater than or equal to the low voltage.

2. The pixel circuit of the OLED as claimed in claim 1, wherein the scan signal is enabled during a data writing phase, the data writing phase is neighboring to a reset phase and a light emitting phase, and the reset phase is prior to the light emitting phase.

3. The pixel circuit of the OLED as claimed in claim 2, wherein during the reset phase, the scan signal is disabled, the first voltage and the second voltage are set to the low voltage, and the third voltage is set to the high voltage.

4. The pixel circuit of the OLED as claimed in claim 2, wherein in the light emitting phase, the scan signal is disabled, the first voltage is set to the high voltage, and the second voltage and the third voltage are set to the low voltage.

5. The pixel circuit of the OLED as claimed in claim 1, further comprising:

a third transistor, having a fifth terminal, a sixth terminal and a third control terminal, wherein the fifth terminal is coupled to the second terminal of the first transistor, the sixth terminal receives the second voltage, and the third control terminal receives a first switch signal, wherein the second terminal of the first transistor receives the second voltage through the third transistor; and a fourth transistor, having a seventh terminal, an eighth terminal and a fourth control terminal, wherein the seventh terminal is coupled to the second terminal of the first transistor, the eighth terminal receives the third voltage, and the fourth control terminal receives a second switch signal;

wherein when the scan signal is enabled, the third transistor is turned-on under control of the first switch signal, and the fourth transistor is turned-off under control of the second switch signal.

6. The pixel circuit of the OLED as claimed in claim 5, wherein the scan signal is enabled during a data writing phase, the data writing phase is neighboring to a reset phase and a light emitting phase, and the reset phase is prior to the light emitting phase, wherein the third transistor is turned-on during the reset phase and the data writing phase under control of the first switch signal, and the fourth transistor is turned-on during the light emitting phase under control of the second switch signal.

7. The pixel circuit of the OLED diode as claimed in claim 5, wherein the first transistor, the second transistor, the third transistor and the fourth transistor are respectively an N-type transistor, and the first switch signal is inverted to the second switch signal.

8. The pixel circuit of the OLED as claimed in claim 5, wherein the first transistor, the second transistor and the third transistor are respectively an N-type transistor, the fourth transistor is a P-type transistor, and the first switch signal is the same to the second switch signal.

9. The pixel circuit of the OLED as claimed in claim 5, wherein the first transistor, the second transistor and the fourth transistor are respectively an N-type transistor, the third transistor is a P-type transistor, and the first switch signal is the same to the second switch signal.

10. The pixel circuit of the OLED as claimed in claim 1, wherein a cathode of the OLED receives the first voltage, and an anode of the OLED is coupled to the first terminal of the first transistor.

11. The pixel circuit of the OLED as claimed in claim 1, wherein the reference voltage is a ground voltage.

* * * * *